US012577875B2

(12) United States Patent
Burgess et al.

(10) Patent No.: US 12,577,875 B2
(45) Date of Patent: Mar. 17, 2026

(54) ROTARY PULSER WITH REGENERATIVE CONTROL

(71) Applicant: APS Technology, LLC, Wallingford, CT (US)

(72) Inventors: Daniel E. Burgess, Portland, CT (US); Jason R. Barbely, East Islip, NY (US)

(73) Assignee: APS Tech LLC, Wallingford, CT (US)

( * ) Notice: Subject to any disclaimer, the term of this patent is extended or adjusted under 35 U.S.C. 154(b) by 0 days.

(21) Appl. No.: 17/976,138

(22) Filed: Oct. 28, 2022

(65) Prior Publication Data

US 2024/0141779 A1 May 2, 2024

(51) Int. Cl.
*E21B 47/20* (2012.01)
*E21B 7/06* (2006.01)

(52) U.S. Cl.
CPC ..... *E21B 47/20* (2020.05); *E21B 7/06* (2013.01)

(58) Field of Classification Search
CPC ..... E21B 47/12; E21B 47/14; E21B 47/20; E21B 47/22; E21B 47/24; E21B 7/06; E21B 41/0085
See application file for complete search history.

(56) References Cited

U.S. PATENT DOCUMENTS

| | | | | |
|---|---|---|---|---|
| 6,714,138 | B1 * | 3/2004 | Turner | E21B 47/20 340/856.4 |
| 7,327,634 | B2 | 2/2008 | Perry et al. | |
| 9,122,259 | B2 * | 9/2015 | Oka | H02P 5/74 |
| 9,446,759 | B2 * | 9/2016 | Murakami | B60W 20/00 |
| 9,605,535 | B2 * | 3/2017 | Logan | E21B 7/04 |
| 10,452,113 | B2 * | 10/2019 | Au Yeung | G05F 1/565 |
| 10,465,506 | B2 * | 11/2019 | Barbely | E21B 47/18 |
| 11,550,008 | B2 * | 1/2023 | Simons | G01R 33/3614 |

* cited by examiner

*Primary Examiner* — Franklin D Balseca
(74) *Attorney, Agent, or Firm* — Offit Kurman; Gregory A. Grissett; Tod A. Kupstas

(57) ABSTRACT

A drill string device configured to operate at a down hole location in a well bore toward a location proximate the surface of an earthen formation includes one or more motors and/or a capacitor bank. The drill string device may be in fluidic communication with a drilling fluid. A first motor of the one or more motors may be operated as part of processing the drilling fluid. A first electrical energy may be provided to the first motor at least as the first motor is operating. A signal to stop the first motor may be received and/or the first motor may be stopped. A second electrical energy may be received from the first motor at least as the first motor is stopping. At least some of the second electrical energy may be directed to the capacitor bank.

20 Claims, 9 Drawing Sheets

ROTARY PULSER WITH REGENERATIVE CONTROL

FIELD OF THE INVENTION

The present disclosure relates generally to a device, system, and methods for controlling a drill bit, and in particular to a device, system and related methods for controlling the drill bit with a rotary pulser having regenerative power control.

BACKGROUND OF THE INVENTION

In underground drilling, such as gas, oil or geothermal drilling, a bore is drilled through a formation deep in the earth. Such bores are formed by connecting a drill bit to sections of long pipe, referred to as a "drill pipe," so as to form an assembly commonly referred to as a "drill string" that extends from the surface to the bottom of the bore. The drill bit is rotated so that it advances into the earth, thereby forming the bore. In rotary drilling, the drill bit is rotated by rotating the drill string and/or the drill bit. In order to lubricate the drill bit and flush cuttings from its path, pumps on the surface pump a high-pressure fluid, referred to as "drilling mud," through an internal passage in the drill string and out through the drill bit. The drilling mud then flows to the surface through the annular passage formed between the drill string and the surface of the bore.

The distal end of a drill string, which includes the drill bit, is referred to as the "bottom hole assembly." In "measurement while drilling" (MWD) applications, sensing modules in the bottom hole assembly provide information concerning the direction of the drilling. This information can be used, for example, to control the direction in which the drill bit advances in a steerable drill string. Such sensors may include a magnetometer to sense azimuth and accelerometers to sense inclination and tool face, among other sensors that measure other parameters.

SUMMARY

Technologies are disclosed for a drill string device configured to operate at a down hole location in a well bore toward a location proximate the surface of an earthen formation. The drill string device may comprise one or more motors and/or a capacitor bank.

The drill string device may comprise a control processor. The control processor may be configured to control operation of a first motor of the one or more motors, perhaps for example as part of processing a drilling fluid. The control processor may be configured to provide a first electrical energy to the first motor, perhaps for example at least as the first motor operates. The control processor may be configured to receive a signal to stop the first motor. The control processor may be configured to stop the first motor. The control processor may be configured to control receipt of a second electrical energy from the first motor, perhaps for example at least as the first motor stops. The control processor may be configured to direct at least some of the second electrical energy to the capacitor bank.

In one or more scenarios, the first motor may be a direct current (DC) motor. In one or more scenarios, the second electrical energy may be produced by the DC Motor, perhaps for example as the DC Motor stops, among other scenarios.

In one or more scenarios, the control processor may be configured to determine that the received second electrical energy is substantially equivalent to a motor energy threshold, above the motor energy threshold, or below the motor energy threshold. The control processor may be configured to switch the second electrical energy to the capacitor bank, perhaps for example upon a determination that the received second electrical energy is substantially equivalent to the motor energy threshold, or above the motor energy threshold.

In one or more scenarios, the control processor may be configured to determine an electrical energy level of the capacitor bank is substantially equivalent to a capacitor energy threshold, above the capacitor energy threshold, or below the capacitor energy threshold. In one or more scenarios, the control processor may be configured to charge the capacitor bank with the second electrical energy, perhaps for example at least upon a determination that the electrical energy level of the capacitor bank is below the capacitor energy threshold.

In one or more scenarios, the control processor may be configured to determine an electrical energy level of the capacitor bank is at least one of: substantially equivalent to a capacitor energy threshold, above the capacitor energy threshold, or below the capacitor energy threshold. The control processor may be configured to provide the first electrical energy to the first motor from the capacitor bank, perhaps for example upon a determination that the electrical energy level of the capacitor bank is substantially equivalent to the capacitor energy threshold, or above the capacitor energy threshold.

In one or more scenarios, the control processor may be configured to determine an electrical energy level of the capacitor bank is substantially equivalent to a capacitor energy threshold, above the capacitor energy threshold, or below the capacitor energy threshold. The control processor may be configured to provide the first electrical energy to the first motor from the capacitor bank, perhaps for example upon a determination that the electrical energy level of the capacitor bank is substantially equivalent to the capacitor energy threshold, or above the capacitor energy threshold.

In one or more scenarios, the drill string device may comprise a battery module. The control processor may be configured to determine an electrical energy level of the capacitor bank is substantially equivalent to a capacitor energy threshold, above the capacitor energy threshold, or below the capacitor energy threshold. The control processor may be configured to provide the first electrical energy to the first motor from the battery module, perhaps for example upon a determination that the electrical energy level of the capacitor bank is below the capacitor energy threshold.

In one or more scenarios, the drill string device may comprise a rotary pulser. The control processor may be configured to provide the first electrical energy to the first motor at least for operation of the first motor in one or more pulses of the rotary pulser.

In one or more scenarios, the control processor may be configured to produce one or more pulses of the rotary pulser. The control processor may be configured to receive one or more pressure pulses produced by the rotary pulser. The control processor may be configured to determine one or more parameters of the one or more pressure pulses.

In one or more scenarios, the one or more parameters of the one or more pressure pulses may include one or more of an amplitude of the one or more pressure pulses, a duration of the one or more pressure pulses, a shape of the one or more pressure pulses, or a frequency of the one or more pressure pulses, for example, among other parameters. In one or more scenarios, the control processor may be configured to interpret one or more characteristics of a drilling operation from the one or more parameters of the pressure pulses, for example.

In one or more scenarios, the DC motor may be a brushless DC motor, an un-commutated DC motor, a permanent magnet DC motor, and/or a wound-stator DC motor.

BRIEF DESCRIPTION OF THE DRAWINGS

The foregoing summary, as well as the following detailed description, will be better understood when read in conjunction with the appended drawings. The drawings show illustrative embodiments of the disclosure. It should be understood, however, that the application is not limited to the precise arrangements and instrumentalities shown.

DETAILED DESCRIPTION OF ILLUSTRATIVE EMBODIMENTS

Figure 1:
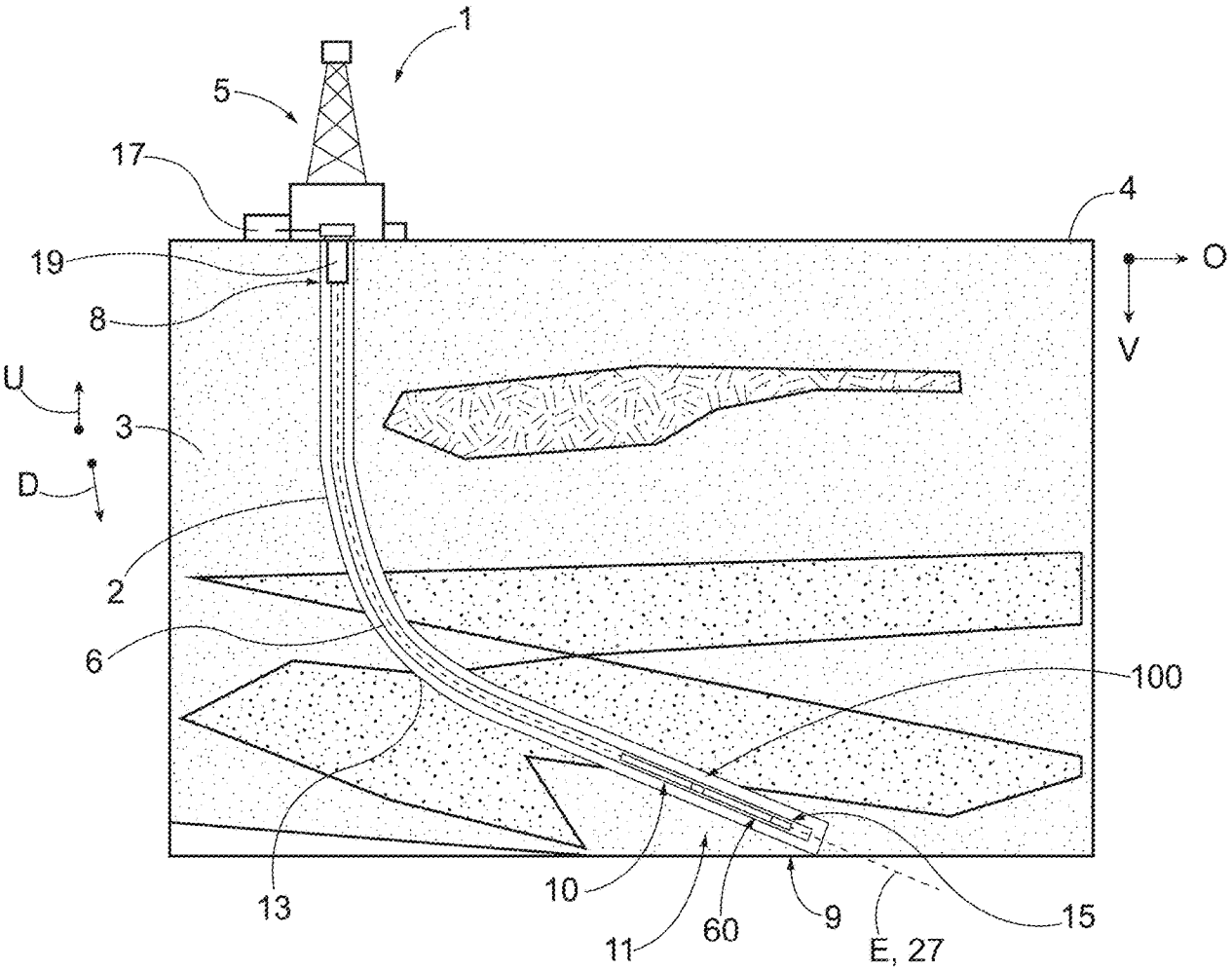
FIG. 1 is a side schematic diagram of an example drilling system including a drill string and dual rotor pulser.

For the purposes of promoting an understanding of the principles of the present disclosure, reference will now be made to the examples illustrated in the drawings, and specific language will be used to describe the same. It will nevertheless be understood that no limitation of the scope of this disclosure is thereby intended.

FIG. 1 is a side schematic diagram of an example drilling system including a drill string and dual rotor pulser. Referring to FIG. 1, a drilling system 1 includes a rig or derrick 5 that supports a drill string 6. The drill string 6 includes a bottomhole (BHA) assembly 11 coupled to a drill bit 15. The drill bit 15 is configured to drill a borehole or well 2 into the earthen formation 3 along a vertical direction V and an offset direction O that is offset from or deviated from the vertical direction V. The drilling system 1 can include a surface motor (not shown) located at the surface 4 that applies torque to the drill string 6 via a rotary table or top drive (not shown), and a downhole motor (not shown) disposed along the drill string 6 that is operably coupled to the drill bit 15. The drilling system 1 is configured to operate in a rotary steering mode, where the drill string 6 and the drill bit 15 rotate, or a sliding mode where the drill string 6 does not rotate but the drill bit does.

Operation of the downhole motor causes the drill bit 15 to rotate along with or without rotation of the drill string 6. Accordingly, both the surface motor and the downhole motor can operate during the drilling operation to define the well 2. During the drilling operation, a pump 17 pumps drilling fluid downhole through an internal passage (not shown) of the drill string 6 out of the drill bit 15 and back to the surface 4 through an annular passage 13 defined between the drill string 6 and well wall. The drilling system 1 can include a casing 19 that extends from the surface 4 and into the well 2. The casing 19 can be used to stabilize the formation near the surface. One or more blowout preventers can be disposed at the surface 4 at or near the casing 19.

Continuing with FIG. 1, the drill string 6 is elongate along a longitudinal central axis 27 that is aligned with a well axis E. The drill string 6 further includes an upstream end 8 and a downstream end 9 spaced from the upstream end 8 along the longitudinal central axis 27. A downhole or downstream direction D refers to a direction from the surface 4 toward the downstream end 9 of the drill string 6. Uphole or upstream direction U is opposite to the downhole direction D. Thus, "downhole" and "downstream" refers to a location that is closer to the drill string downstream end 9 than the surface 4, relative to a point of reference. "Uphole" and "upstream" refers to a location that is closer to the surface 4 than the drill string downstream end 9, relative to a point of reference. The drilling system 1 can include one or more telemetry systems 100, one or more computing devices 200, and one or more downhole tools used to obtain data concerning the drilling operation during drilling. The telemetry system 100 facilitates communication among the surface control system components and downhole control system. For instance, in a drilling operation, the drill bit 15 drills a bore hole into an earthen formation.

A mud pump pumps drilling fluid downward through the drill string 6 and into the drill bit 15. The drilling fluid flows upward to the surface through the annular passage 13 between the bore hole and the drill string 6, where, after cleaning, it is recirculated back down the drill string 6 by the mud pump. Also, in MWD and LWD systems, sensors, such as those of the types discussed above, are located in the bottom hole assembly portion of the drill string. The pulser 10 is located in the drill collar of the bottom hole assembly 11 so that drilling fluid flows through the pulser 10. By generating encoded pressure pulses, the pulser transmits information, such as information from the sensors, to the surface.

Figure 2:
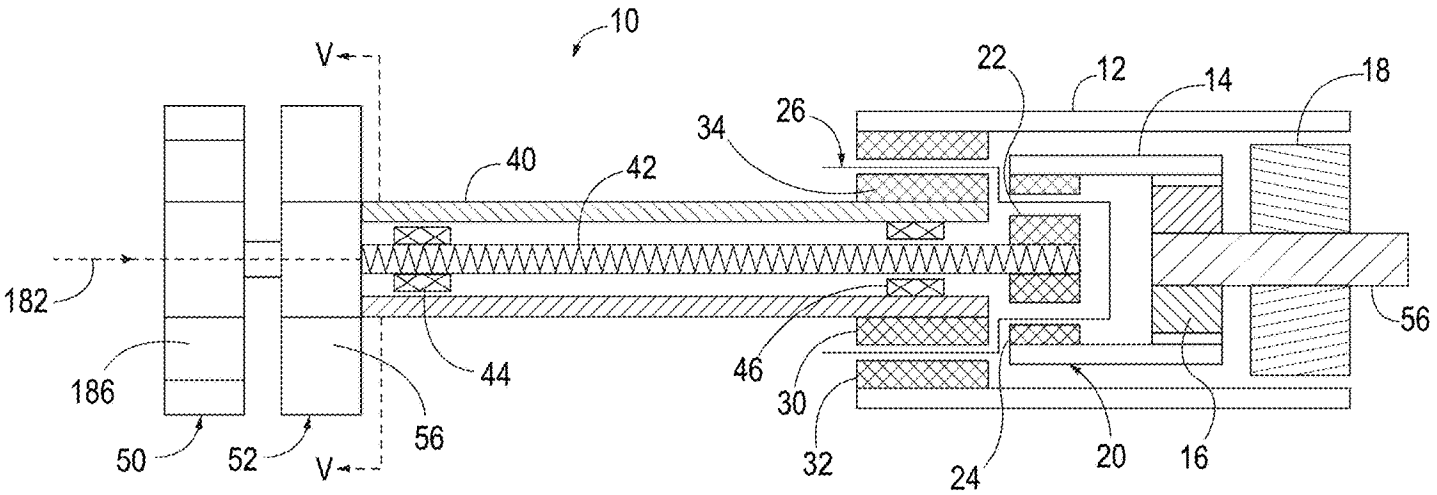
FIG. 2 is an example schematic diagram of a mud pulser telemetry system.

FIG. 2 illustrates a dual rotor pulser 10 according to an embodiment of the present disclosure. The dual rotor pulser may include an outer housing assembly (not shown in FIG. 2) which is mounted to the drill collar or a section of drill pipe. In some embodiments, the outer housing assembly may be a portion of the drill collar or drill pipe. The pulser 10 has first and second motors 16 and 18, respectively, mounted on a shaft 56. The motors 16 and 18 are preferably brushed reversible DC motors supplied with power from a power source, such as a battery or a turbine alternator driven by the flow of drilling fluid. The first motor 16 drives a rotatable inner housing 14. The inner housing 14 drives an inner shaft 42 via a first magnetic coupling 20. An inner portion 22 of the magnetic coupling 20 is mounted on the inner shaft 42 and disposed radially inboard of a pressure housing 26, while an outer portion 24 is mounted on the inner housing 14 and disposed radially outboard of the pressure housing. This allows the magnetic coupling 20 to transmit torque across the pressure housing 26.

As discussed in U.S. Pat. No. 6,714,138 (Turner et al.) and U.S. Pat. No. 7,327,634 (Perry et al.), incorporated by reference above and providing mechanical details concerning the construction of a pulser, on one side of the pressure housing 26 is a gas-filled chamber in which the motors 16 and 18 are located, whereas an oil-filled chamber is formed on the other side of the pressure housing. The inner shaft 42 is supported on bearings 44 and 46 and drives rotation of a first rotor 50.

Figure 3B:
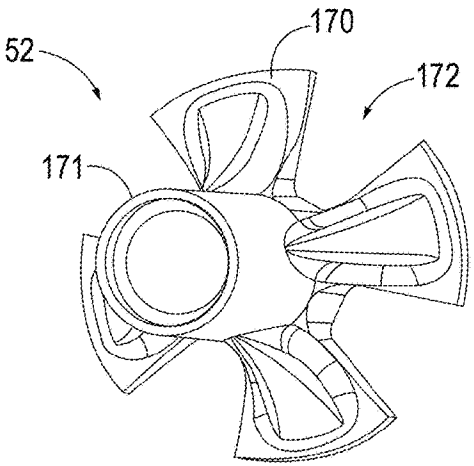
FIG. 3B is a perspective view of an example second pulser rotor.
Figure 3A:
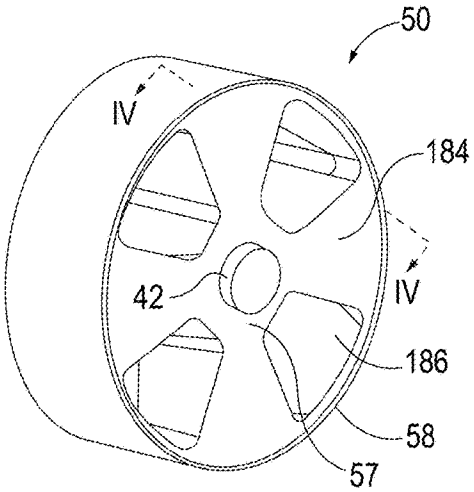
FIG. 3A is a perspective view of an example first pulser rotor.
Figure 4:
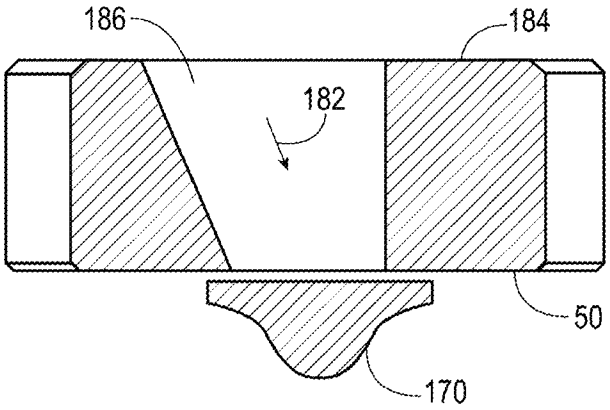
FIG. 4 is a cross-sectional view of example first and second pulser rotors.

As shown in FIGS. 3A, 3B and 4, according to one embodiment of the invention, the first rotor 50 comprises a hub 57 mounted on the inner shaft 42 and a rim 58. A series of blades 184 extending between the hub 57 and the rim 58 form generally axially extending passages 186 therebetween through which the drilling mud 182 flows. As shown in FIG. 4, at least one of the walls of the passages 186 may, but need not, be oriented at an angle to the axial direction so as to impart swirl to the flow of drilling mud 182 in additional to swirl created by the rotation of the rotor 50.

Continuing with FIG. 2, the second motor 18, which is disposed adjacent the first motor, drives a rotatable outer housing 12. The outer housing 12 drives an outer shaft 40, arranged coaxially with respect to the inner shaft 42, via a second magnetic coupling 30. An inner portion 34 of the second magnetic coupling 30 is mounted on the outer shaft 40 and disposed radially inboard of the pressure housing 26, while an outer portion 32 is mounted on the outer housing 12 and disposed radially outboard of the pressure housing. This allows the second magnetic coupling 30 to transmit torque across the pressure housing 26 to the outer shaft 40, which drives rotation of a second rotor 52.

As shown in FIG. 2, the second rotor 52 is preferably disposed immediately downstream from the first rotor 50. The second rotor 52 comprises a hub 171, which is mounted on the outer shaft 40. A plurality of rotor blades 170 extending radially outward from the hub so as to form passages 172 therebetween through which the drilling fluid 182 flows. In the illustrated embodiment, the rotors 50 and 52 have radially extending blades that form passages therebetween. In alternative embodiments of the present disclosure, other types of rotors in which a portion of one rotor was capable of at least partially blocking the flow of drilling fluid through the other rotor, such as rotors formed by discs in which holes were formed, may be used.

The pulsers according to an embodiment of present disclosure need not utilize a stationary stator. Specifically, the first and second rotors 50 and 52 are arranged adjacent to each other so that the blades of each rotor can at least partially, and in some cases almost fully, block the flow of drilling fluid through the passages in the adjacent rotor when the blades are circumferentially aligned with the passages. Furthermore, the pulser 10 could include at least two rotors that are similar to each other. For instance, the first and second rotor could be similar to rotor 50 illustrated in FIG. 3A. In another embodiment, the first and second rotors can be configured similar to rotor 52 illustrated in FIG. 3B. In the embodiment illustrated, the first rotor is similar to rotor 50 in FIG. 3A and the second rotor is similar to rotor 52 in FIG. 3B. Accordingly, a "rotor" as used throughout the present disclosure includes a rotatable structure that includes a plurality of passages through which drilling fluid can flow. A "stator" is a structure that is fixed, or held stationary, and that includes at least one passage through which drilling fluid can flow.

Figure 6:
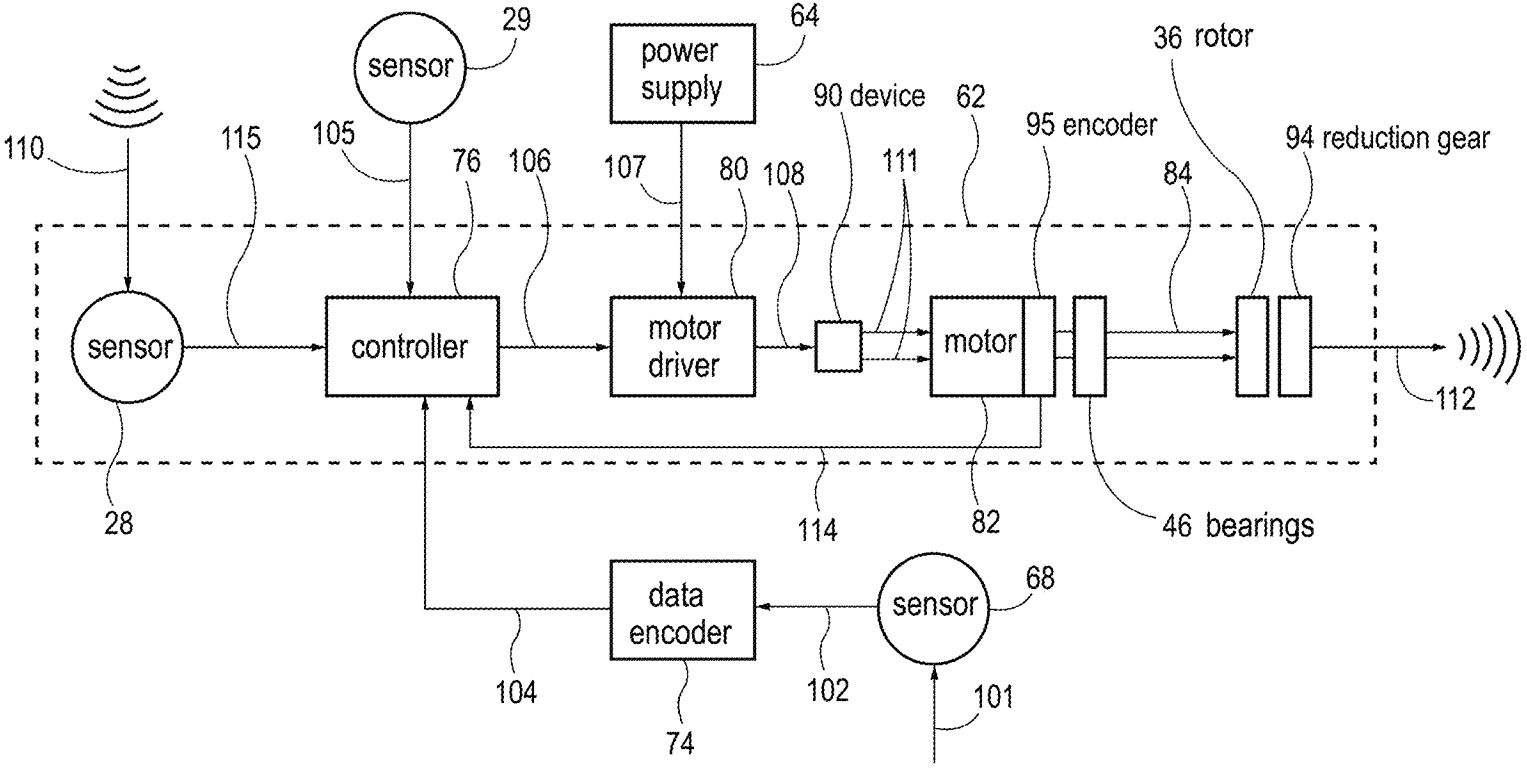
FIG. 6 is an example schematic diagram of an example mud pulser telemetry system.

The first and second motors 16 and 18 are separately controlled by a controller, such as by the controller (not shown) shown in FIG. 6, so that the two rotors 50 and 52 need not be rotated in the same manner. Based on the digital code from a data encoder, the controller directs control signals to drivers for the motors 16 and 18. In a preferred embodiment, the motor driver receives power from the power source and directs power to a switching device. The switching device transmits power to the appropriate windings of the motors so as to effect rotation of the rotors in either a first (e.g., clockwise) or opposite (e.g., counterclockwise) direction so as to generate pressure pulses that are transmitted through the drilling mud. The pressure pulses are sensed by a sensor at the surface and the information is decoded and directed to a data acquisition system for further processing.

Figure 5A:
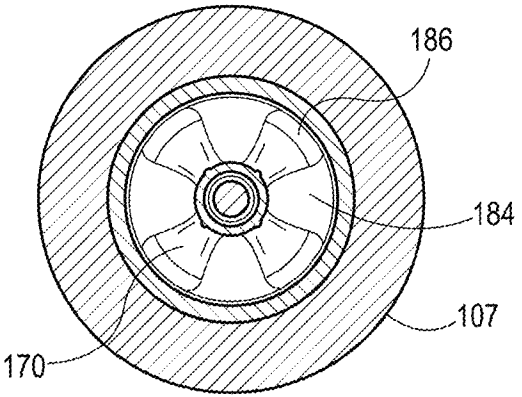
FIG. 5A is a cross-sectional view of the example pulser taken along line V-V shown in FIG. 2 with the rotors in a maximum obstruction configuration.
Figure 5C:
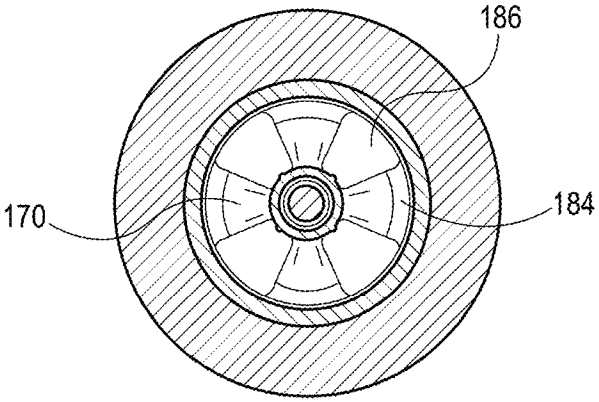
FIG. 5C is a cross-sectional view of the example pulser taken along line V-V shown in FIG. 2 with the rotors in a minimum obstruction configuration.
Figure 5B:
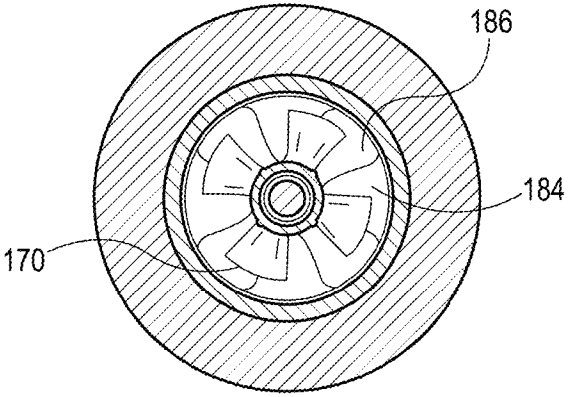
FIG. 5B is a cross-sectional view of the example pulser taken along line V-V shown in FIG. 2 with the rotors in an intermediate obstruction configuration.

According to an embodiment, a pressure pulse is created in the drilling fluid whenever the one or both of the rotors rotate from a relative circumferential orientation in which the rotor blades of one rotor are not aligned with the passages in the other rotor and, therefore, do not obstruct the passages in the other rotor as shown in FIG. 5C, or are only partially aligned with the passages as shown in FIG. 5B, to a circumferential orientation in which the blades are fully aligned with the passages in the other rotor as shown in FIG. 4 and FIG. 5A so as to provide the maximum obstruction to the flow of drilling fluid. A pressure pulse is also created in the drilling fluid whenever the blades of one rotor rotate from a circumferential orientation in which they are partially aligned with the passages of the other rotor and, therefore, partially obstruct the flow of drilling fluid as shown in FIG. 5B, to a circumferential orientation in which the blades are not aligned with the passages in the other rotor as shown in FIG. 5C.

The rotary pulser as described herein provides flexibility in terms of the operating mode of the pulser. In operation, one or both of the rotors 50 and 52 can be rotated continuously in the same or opposite directions, or both of the rotors can be oscillated, or one of the rotors can oscillate while the other rotates continuously in one direction. Further, one rotor can be rotated while the other rotor remains stationary, so that the stationary rotor acts as a stator. Alternatively, one rotor can be operated at a constant rotary speed, thereby generating a carrier wave within the drilling fluid, while the other rotor can rotate at a different constant rotary speed in the same direction so as to impart a phase shift in the carrier wave that is used to transmit information.

In one or more scenarios, the rotors can be rotated in the same direction or in opposite directions. The pulser has one or more clearing operating modes when debris jams or plugs the pulser 10 such that one or both rotors 50 and 52 can be rotated as necessary to clear the debris. For example, one clearing operating mode is where one rotor rotates in a first direction while the other rotor remains stationary. In another example of a clearing operating mode is where a first rotor rotates in a first direction while the second rotor rotates in a second direction that is opposite to the first direction. In yet another example of a clearing operating mode, the first rotor remains stationary and the second rotor rotates.

Technologies that may provide for electrical energy to operate, at least partially, one or more motors of a drill string beyond, and/or in addition to, a battery/battery back system of a drill string could be useful. Further, technologies that may provide for charging/recharging and/or replenishment of electrical energy to/for such sources of electrical energy could be useful.

Without the capabilities, techniques, methods, and/or devices described herein, the skilled artisan would not appreciate how to provide electrical energy for at least partial operation of one or more motors of a drill string other than a battery/battery back system, where such technologies may provide for charging/recharging and/or replenishment of electrical energy to/for such sources of electrical energy.

FIG. 6 is an example schematic diagram of a mud pulser telemetry system. As shown in FIG. 6, in addition to the sensors 68, the components of the mud pulse telemetry system according to the current invention include a conventional mud telemetry data encoder 74, a power supply 64, which may be a battery or turbine alternator, and a down hole pulser 62 according to the current invention. The pulser comprises a controller 76, which may be a microprocessor, a motor driver 80, which includes a switching device 90, a reversible motor 82, a reduction gear 94 and a rotor 36. The motor driver 80, which may be a current limited power stage comprised of transistors (field effect transistors (FET's), bipolar transistors, etc.), preferably receives power from the power supply 64 and directs it to the motor 82 using pulse width modulation. Preferably, the motor is a brushed DC motor with an operating speed of at least about 600 RPM and, preferably, about 6000 RPM. The motor 82 drives the reduction gear 94, which is coupled to the rotor shaft 84. Although only one reduction gear 94 is shown, it should be understood that two or more reduction gears could also be utilized. Preferably, the reduction gear 94 achieves a speed reduction of at least about 144:1. The sensors 68 receive information 101 useful in connection with the drilling operation and provide output signals 102 to the data encoder 74. Using techniques well known in the art, the data encoder 74 transforms the output from the sensors 68 into a digital code 104 that it transmits to the controller 76. Based on the digital code 104, the controller 76 directs control signals 106 to the motor driver 80.

The motor driver 80 receives power 107 from the power source 64 and directs power 108 to a switching device 90. The switching device 90 transmits power 111 to the appropriate windings of the motor 82 so as to effect rotation of the rotor 36 in either a first (e.g., clockwise) or opposite (e.g., counterclockwise) direction so as to generate pressure pulses 112 that are transmitted through the drilling mud 182. The pressure pulses 112 are sensed by the sensor at the surface and the information is decoded and directed to a data acquisition system for further processing, as is conventional. The pressure pulses 112 generated at the down hole pulser 62 may have an amplitude. The shape of the pulses may be less distinct and/or noise may be superimposed on the pulses.

In one or more scenarios, a down hole static pressure sensor 29 may be incorporated into the drill string to measure the pressure of the drilling mud in the vicinity of the pulser 62. As shown in FIG. 6, the static pressure sensor 29, which may be a strain gage type transducer, transmits a signal 105 to the controller 76 containing information on the static pressure. In one or more scenarios, the static pressure sensor 29 may be incorporated into the drill collar of the drill bit (not shown). In one or more scenarios, the static pressure sensor 29 could also be incorporated into the down hole pulser 62.

In one or more scenarios, the down hole pulser 62 may include a down hole dynamic pressure sensor 28 that senses pressure pulsations 110 in the drilling mud (not shown) in the vicinity of the pulser 62. The pressure pulsations sensed by the sensor 28 may be the pressure pulses generated by the down hole pulser 62 or the pressure pulses generated by the surface pulser. In either case, the down hole dynamic pressure sensor 28 transmits a signal 115 to the controller 76 containing the pressure pulse information, which may be used by the controller in generating the motor control signals 106. The down hole pulser 62 may also include an orientation encoder 95 suitable for high temperature applications, coupled to the motor 82. The orientation encoder 95 directs a signal 114 to the controller 76 containing information concerning the angular orientation of the rotor 36, which may also be used by the controller in generating the motor control signals 106. The orientation encoder 95 is of the type employing a magnet coupled to the motor shaft that rotates within a stationary housing in which Hall effect sensors are mounted that detect rotation of the magnetic poles.

Figure 7:
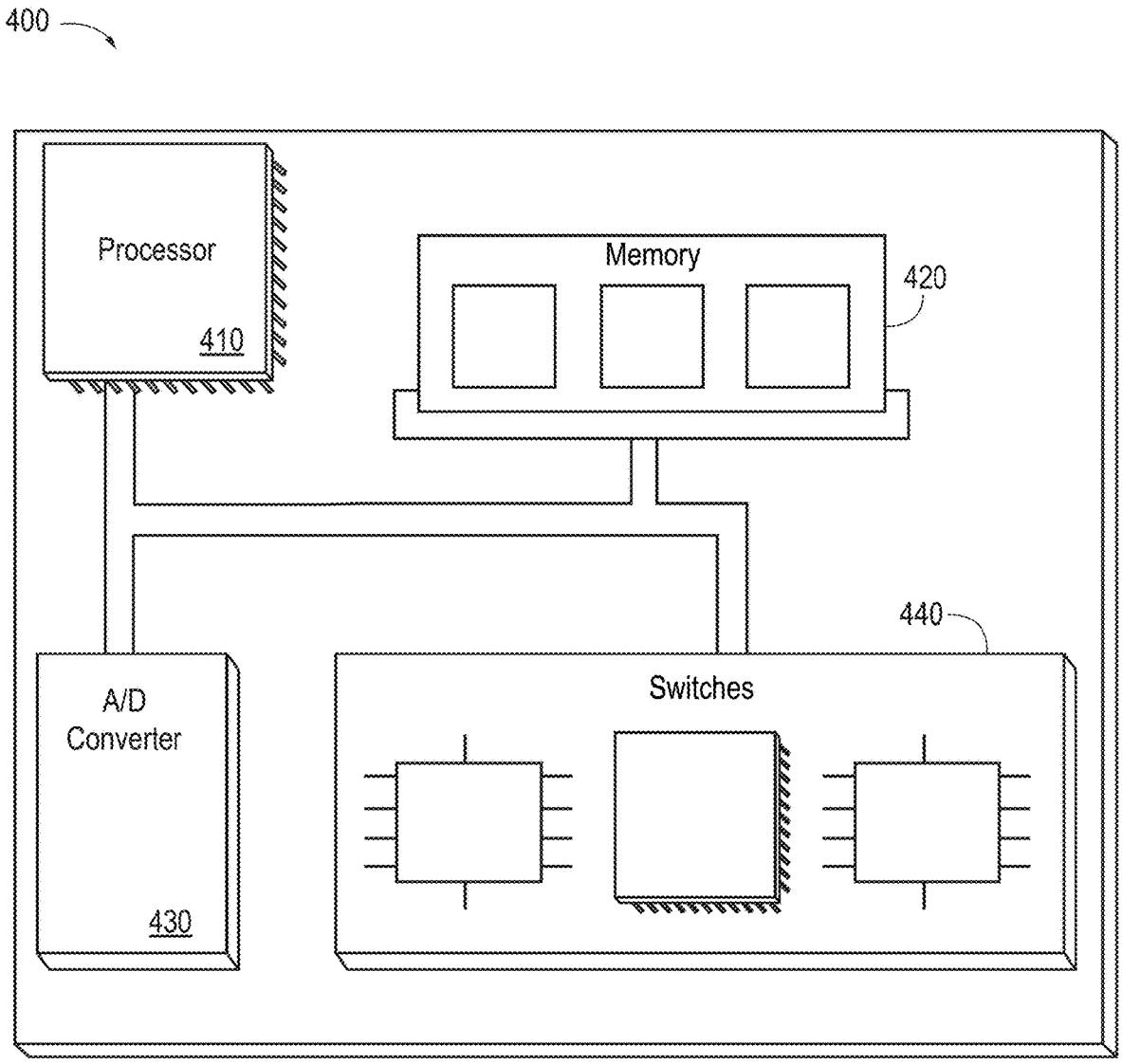
FIG. 7 is a block diagram of a hardware configuration of an example control processor.

FIG. 7 is a block diagram of a hardware configuration of an example control processor (e.g., "processor", "control module", etc.). The hardware configuration 400 is able to process and control the electrical signal to the pulser motor. The hardware configuration 400 can include a processor 410, a memory 420, an analog/digital converter 430, and switches 440.

The memory 420 can store information about the pulses which were received and generated by the controller. This information could consist of the time, speed, pulse width and braking information which could be used for diagnostics if required.

The high current switches 440 will be able to control the flow of electrical energy both to the motor and to the capacitors.

The switches 440 and A/D converter 430 will provide the means to read in from the resolver in order for the processor 410 to measure the rotational position of the rotor in relation to the passages.

In one or more scenarios, a drill string device may be configured to operate at a down hole location in a well bore toward a location proximate the surface of an earthen formation. The drill string device may comprise one or more motors and/or a capacitor bank.

The drill string device may comprise a control processor. The control processor may be configured to control operation of a first motor of the one or more motors, perhaps for example as part of processing a drilling fluid. The control processor may be configured to provide a first electrical energy to the first motor, perhaps for example at least as the first motor operates. The control processor may be configured to receive a signal to stop the first motor. The control processor may be configured to stop the first motor. The control processor may be configured to control receipt of a second electrical energy from the first motor, perhaps for example at least as the first motor stops. The control processor may be configured to direct at least some of the second electrical energy to the capacitor bank.

In one or more scenarios, the first motor may be a direct current (DC) motor. In one or more scenarios, the second electrical energy may be produced by the DC Motor, perhaps for example as the DC Motor stops, among other scenarios.

In one or more scenarios, the control processor may be configured to determine that the received second electrical energy is substantially equivalent to a motor energy threshold, above the motor energy threshold, or below the motor energy threshold. The control processor may be configured to switch the second electrical energy to the capacitor bank, perhaps for example upon a determination that the received second electrical energy is substantially equivalent to the motor energy threshold, or above the motor energy threshold. In one or more scenarios, the motor energy threshold will be in the range of 2 to 3 amps peak, for example.

In one or more scenarios, the control processor may be configured to determine an electrical energy level of the capacitor bank is substantially equivalent to a capacitor energy threshold, above the capacitor energy threshold, or below the capacitor energy threshold. In one or more scenarios, the control processor may be configured to charge the capacitor bank with the second electrical energy, perhaps for example at least upon a determination that the electrical energy level of the capacitor bank is below the capacitor energy threshold. In one or more scenarios, the capacitor energy threshold may be in the range of 2 to 3 amps, for example.

In one or more scenarios, the control processor may be configured to determine an electrical energy level of the capacitor bank is at least one of: substantially equivalent to a capacitor energy threshold, above the capacitor energy threshold, or below the capacitor energy threshold. The control processor may be configured to provide the first electrical energy to the first motor from the capacitor bank, perhaps for example upon a determination that the electrical energy level of the capacitor bank is substantially equivalent to the capacitor energy threshold, or above the capacitor energy threshold.

In one or more scenarios, the control processor may be configured to determine an electrical energy level of the capacitor bank is substantially equivalent to a capacitor energy threshold, above the capacitor energy threshold, or below the capacitor energy threshold. The control processor may be configured to provide the first electrical energy to the first motor from the capacitor bank, perhaps for example upon a determination that the electrical energy level of the capacitor bank is substantially equivalent to the capacitor energy threshold, or above the capacitor energy threshold.

In one or more scenarios, the drill string device may comprise a battery module. The control processor may be configured to determine an electrical energy level of the capacitor bank is substantially equivalent to a capacitor energy threshold, above the capacitor energy threshold, or below the capacitor energy threshold. The control processor may be configured to provide the first electrical energy to the first motor from the battery module, perhaps for example upon a determination that the electrical energy level of the capacitor bank is below the capacitor energy threshold.

In one or more scenarios, the drill string device may comprise a rotary pulser. The control processor may be configured to provide the first electrical energy to the first motor at least for operation of the first motor in one or more pulses of the rotary pulser.

In one or more scenarios, the control processor may be configured to produce one or more pulses of the rotary pulser. The control processor may be configured to receive one or more pressure pulses produced by the rotary pulser. The control processor may be configured to determine one or more parameters of the one or more pressure pulses.

In one or more scenarios, the one or more parameters of the one or more pressure pulses may include one or more of an amplitude of the one or more pressure pulses, a duration of the one or more pressure pulses, a shape of the one or more pressure pulses, or a frequency of the one or more pressure pulses, for example, among other parameters. In one or more scenarios, the control processor may be configured to interpret one or more characteristics of a drilling operation from the one or more parameters of the pressure pulses, for example.

In one or more scenarios, the DC motor may be a brushless DC motor, an un-commutated DC motor, a permanent magnet DC motor, and/or a wound-stator DC motor.

Figure 8:
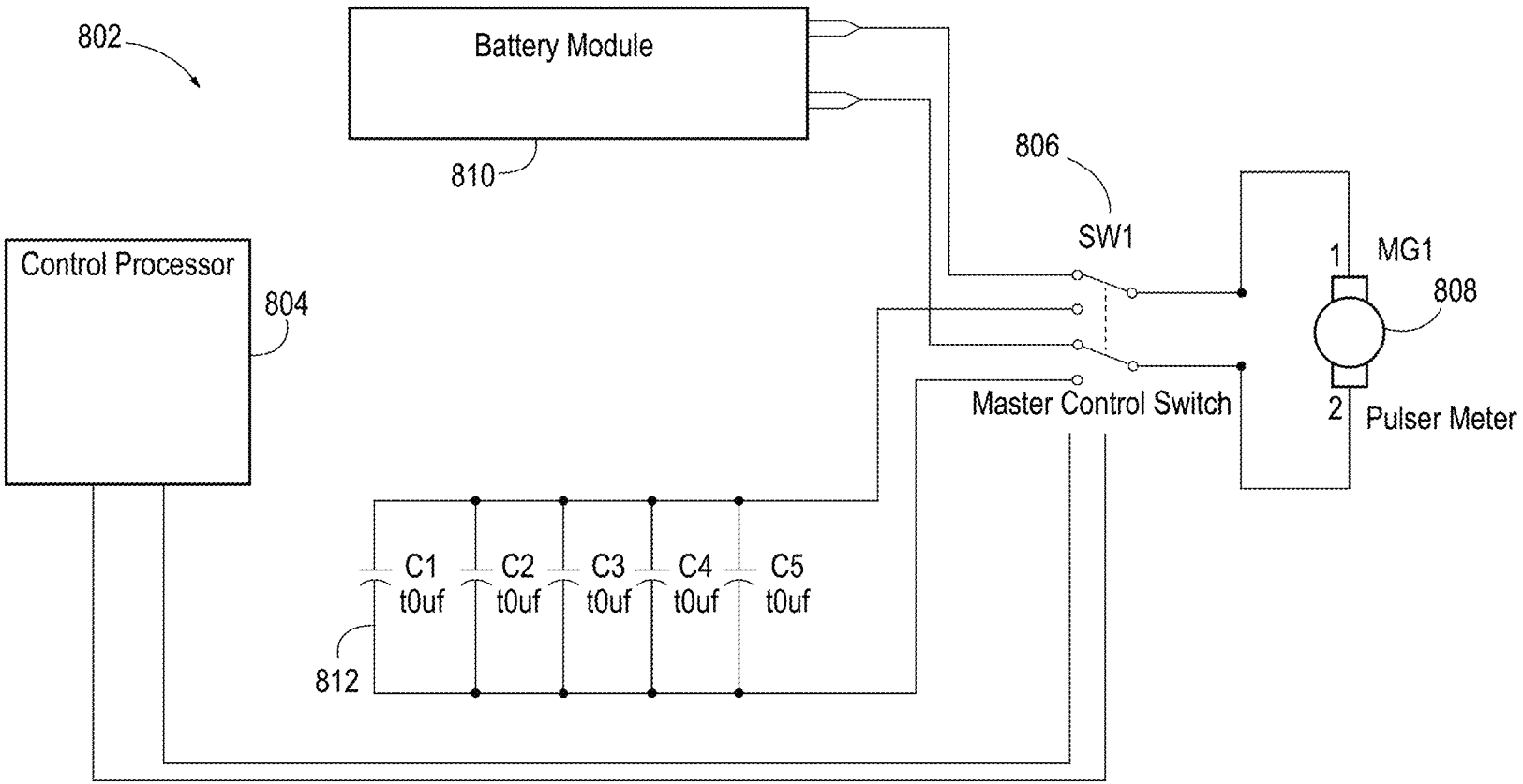
FIG. 8 is an example diagram of at least one technique for supplying electrical energy to one or more motors of a drill string.

FIG. 8 is an example diagram of at least one technique 802 for supplying electrical energy to one or more motors of a drill string device (not shown). A control processor 804 (e.g., such as described with regard to FIG. 7) may be configured to control a master control switch/SW1 806 to switch (e.g., FETs, or the like) at least one motor/MC1 808 of a drill string device (e.g., a pulser motor, etc.) to a battery module 810. In one or more scenarios, the control processor 804 may be configured to switch the motor 808 to the battery module 810 from a capacitor bank 812, perhaps for example upon a determination that a capacitor bank energy level may have dropped below a threshold, among other scenarios. In one or more scenarios, the capacitor bank may comprise several individual capacitors (e.g., ten capacitors) with a capacitance range of 100 uF. In an aspect, the capacitor bank will consist of several high temperature ceramic surface mount capacitors in a parallel configuration.

Figure 9:
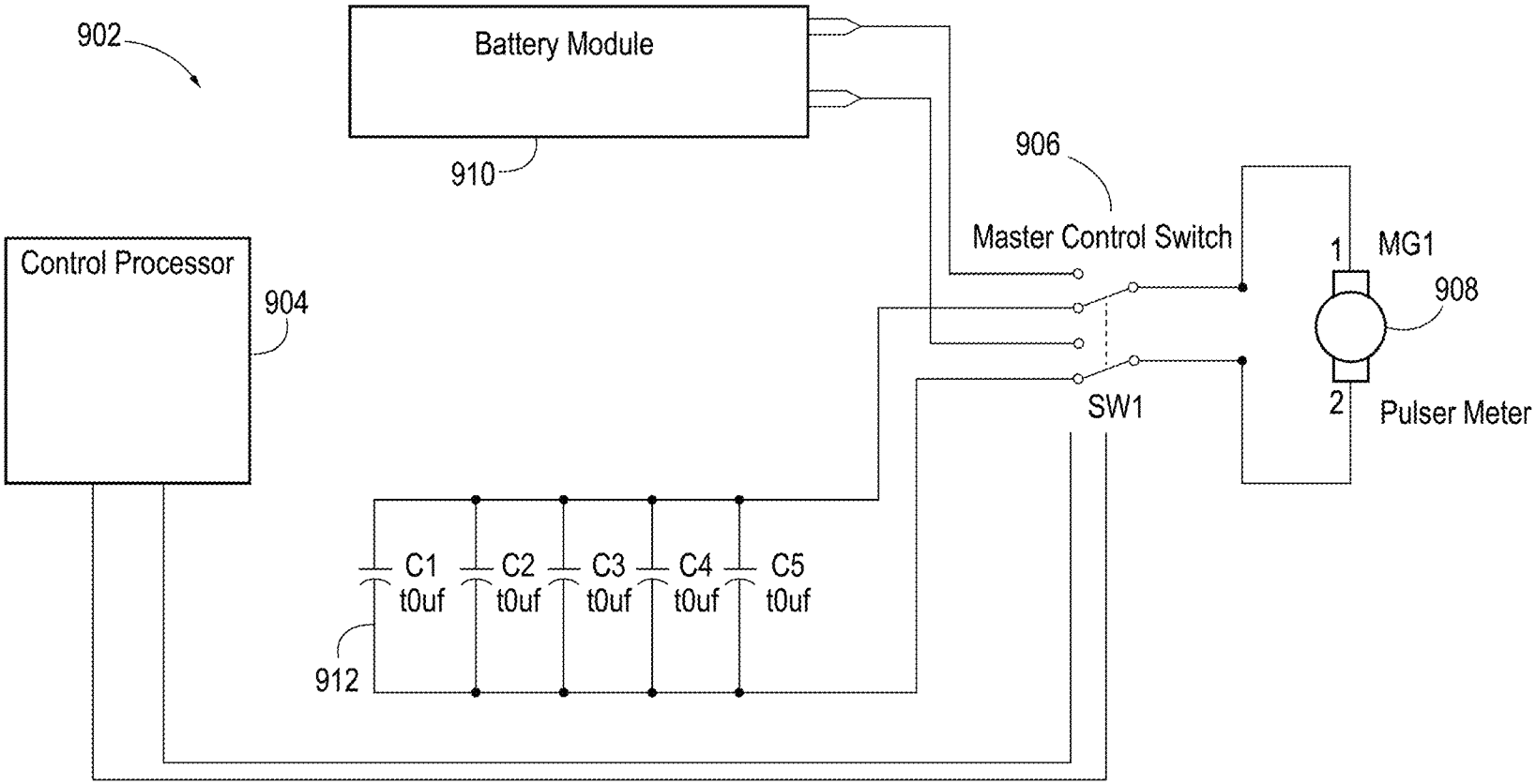
FIG. 9 is an example diagram of at least one technique for supplying electrical energy.

FIG. 9 is an example diagram of at least one technique 902 for supplying electrical energy to one or more motors of a drill string device (not shown). A control processor 904 may be configured to control a master control switch/SW1 906 to switch (e.g., FETs, or the like) at least one motor/MC1 908 of a drill string device (e.g., a pulser motor, etc.) to a capacitor bank 912. In one or more scenarios, the control processor 904 may be configured to switch the motor 908 to the capacitor bank 912 from a battery module 910, perhaps for example upon a determination that a capacitor bank energy level may be at and/or above a threshold, among other scenarios. For example, the control processor 904 may be configured to control the master control switch 906 to the capacitor bank 912 perhaps for example to charge the capacitor bank 912 with electrical energy generated by the motor 908 as motor 908 is stopping/braking (e.g., inertial/regenerative electrical energy production from motor 908).

Figure 10:
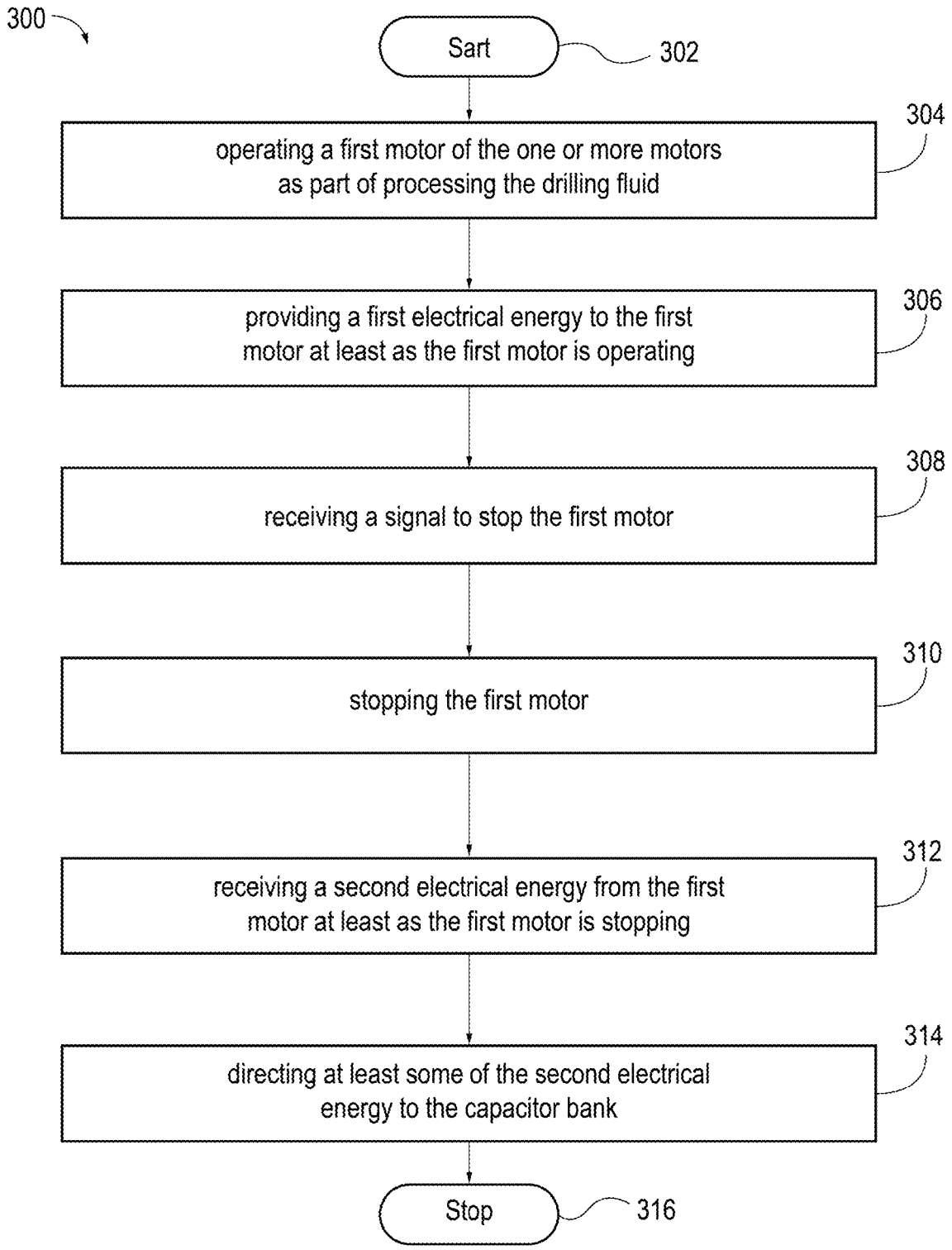
FIG. 10 is an example flow diagram of at least one technique for providing electrical energy to a capacitor bank of a drill string.

Referring now to FIG. 10, a diagram 300 illustrates an example technique by a drill string device operating at a down hole location in a well bore toward a location proximate the surface of an earthen formation. The drill string device may comprise one or more motors and/or a capacitor bank. The drill string device may be in fluidic communication with a drilling fluid.

At 302, the process may start or restart. At 304, the drill string device may operate a first motor of the one or more motors as part of processing the drilling fluid. At 306, the drill string device may provide a first electrical energy to the first motor at least as the first motor is operating.

At 308, the drill string device may receive a signal to stop the first motor. At 310, the drill string device may stop the first motor. At 312, the drill string device may receive a second electrical energy from the first motor at least as the first motor is stopping. At 314, the drill string device may direct at least some of the second electrical energy to the capacitor bank. At 316, the process may stop or restart.

Figure 11:
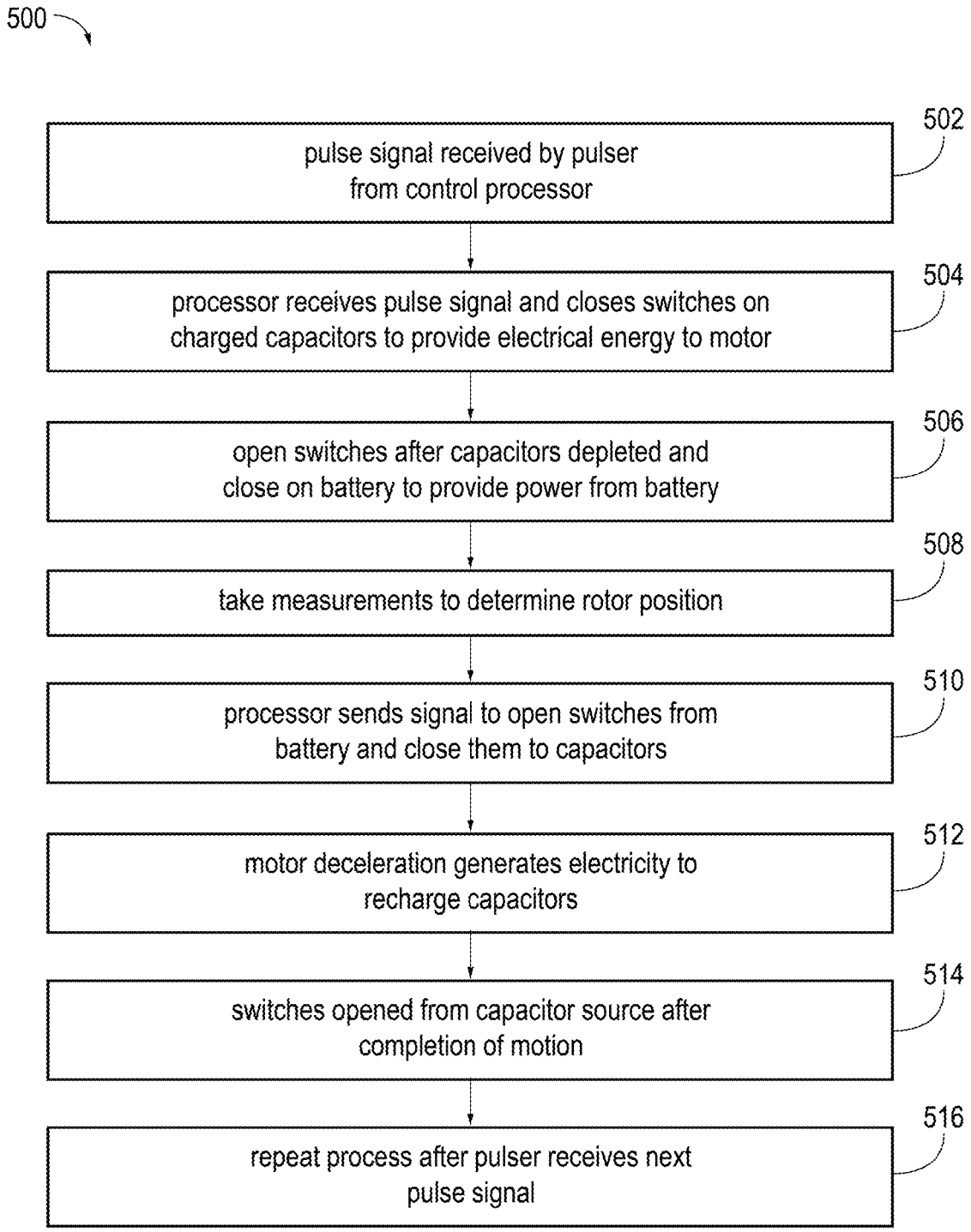
FIG. 11 is an example flow diagram of at least one technique for processing motion.

Referring now to FIG. 11, a diagram 500 illustrates an example technique for processing motion. At 502, a pulse signal is received by the pulser from the MWD control processor. At 504, the control processor receives the pulse signal and closes the switches on the charged capacitors to provide electrical energy to the motor. At 506, once the capacitors are depleted, the switches open from the capacitors and close on the battery in order to continue to provide power from the battery. Thereafter, at 508, a measurement is taken from the resolver to determine the position of the rotor. The resolver continuously measures the position of the rotor and sends that information back to the pulser processor. At 510, once a full motion is reached, the pulser processor sends a signal to open the switches from the battery and close them to the capacitors.

At 512, when the motor decelerates, its rotational energy generates electricity required to recharge the capacitors. Thereafter, at 514, the switches are opened from the capacitor source after completion of motion. Finally, at 516, the pulser control processor stops until the next signal is received and restarts at step 502.

Those skilled in the art will appreciate that the disclosed subject matter improves upon methods and/or apparatuses for supplying electrical energy to one or more motors of a drill string, such as a pulser motor, for example. A burden on a drill string battery/battery back system may be reduced and/or the service time of the battery/battery back system may be increased by providing electrical energy to one or more drill string motors from a capacitor bank and/or recharging/replenishing the capacitor bank electrical energy from a braking/stopping motor of the drill string.

The subject matter of this disclosure, and components thereof, can be realized by instructions that upon execution cause one or more processing devices to carry out the processes and/or functions described herein. Such instructions can, for example, comprise interpreted instructions, such as script instructions, e.g., JavaScript or ECMAScript instructions, or executable code, and/or other instructions stored in a computer readable medium.

Implementations of the subject matter and/or the functional operations described in this specification and/or the accompanying figures can be provided in digital electronic circuitry, in computer software, firmware, and/or hardware, including the structures disclosed in this specification and their structural equivalents, and/or in combinations of one or more of them. The subject matter described in this specification can be implemented as one or more computer program products, e.g., one or more modules of computer program instructions encoded on a tangible program carrier for execution by, and/or to control the operation of, data processing apparatus.

A computer program (also known as a program, software, software application, script, or code) can be written in any form of programming language, including compiled or interpreted languages, and/or declarative or procedural languages. It can be deployed in any form, including as a stand-alone program or as a module, component, subroutine, and/or other unit suitable for use in a computing environment. A computer program may or might not correspond to a file in a file system. A program can be stored in a portion of a file that holds other programs and/or data (e.g., one or more scripts stored in a markup language document), in a single file dedicated to the program in question, and/or in multiple coordinated files (e.g., files that store one or more modules, sub programs, or portions of code). A computer program can be deployed to be executed on one computer or on multiple computers that may be located at one site or distributed across multiple sites and/or interconnected by a communication network.

The processes and/or logic flows described in this specification and/or in the accompanying figures may be performed by one or more programmable processors executing one or more computer programs to perform functions by operating on input data and/or generating output, thereby tying the process to a particular machine (e.g., a machine programmed to perform the processes described herein). The processes and/or logic flows can also be performed by, and apparatus can also be implemented as, special purpose logic circuitry, e.g., an FPGA (field programmable gate array) and/or an ASIC (application specific integrated circuit).

Computer readable media suitable for storing computer program instructions and/or data may include all forms of non-volatile memory, media and memory devices, including by way of example semiconductor memory devices (e.g., EPROM, EEPROM, and/or flash memory devices); magnetic disks (e.g., internal hard disks or removable disks); magneto optical disks; and/or CD ROM and DVD ROM disks. The processor and/or the memory can be supplemented by, or incorporated in, special purpose logic circuitry.

While this specification and the accompanying figures contain many specific implementation details, these should not be construed as limitations on the scope of any invention and/or of what may be claimed, but rather as descriptions of features that may be specific to described example implementations. Certain features that are described in this specification in the context of separate implementations can also be implemented in combination in perhaps one implementation. Various features that are described in the context of perhaps one implementation can also be implemented in multiple combinations separately or in any suitable sub-combination. Although features may be described above as acting in certain combinations and/or perhaps even (e.g., initially) claimed as such, one or more features from a claimed combination can in some cases be excised from the combination. The claimed combination may be directed to a sub-combination and/or variation of a sub-combination.

While operations may be depicted in the drawings in an order, this should not be understood as requiring that such operations be performed in the particular order shown and/or in sequential order, and/or that all illustrated operations be performed, to achieve useful outcomes. The described program components and/or systems can generally be integrated together in a single software product and/or packaged into multiple software products.

Examples of the subject matter described in this specification have been described. The actions recited in the claims can be performed in a different order and still achieve useful outcomes, unless expressly noted otherwise. For example, the processes depicted in the accompanying figures do not require the particular order shown, and/or sequential order, to achieve useful outcomes. Multitasking and parallel processing may be advantageous in one or more scenarios.

While the present disclosure has been illustrated and described in detail in the drawings and foregoing description, the same is to be considered as illustrative and not restrictive in character, it being understood that only certain examples have been shown and described, and that all changes and modifications that come within the spirit of the present disclosure are desired to be protected.

What is claimed:

1. A method for operating a pulser at a down hole location in a well bore in an earthen formation, the pulser being in fluidic communication with a drilling fluid, the method comprising:

operating a first motor of one or more motors of the pulser in order to rotate at least one rotatable element of the pulser, wherein rotation of the at least one rotatable element generates a pressure pulse in the drilling fluid;

supplying a first electrical energy to the first motor to rotate the at least one rotatable element as the first motor is operating;

taking a measurement to determine a position of the at least one rotatable element and sending the measurement to a control processor of the pulser, wherein determined position of the at least one rotatable element is used to determine opening and closing of at least one switch to a battery module or a capacitor bank of the pulser;

initiating a signal to stop the first motor in order to stop rotation of the at least one rotatable element of the pulser;

in response to receiving the signal, stopping the first motor to stop rotation of the at least one rotatable element;

receiving a second electrical energy from the first motor as the first motor is stopping the rotation of the at least one rotatable element; and directing with the control processor of the pulser at least some of the second electrical energy to the capacitor bank of the pulser.

2. The method of claim 1, wherein the first motor is a direct current (DC) motor.

3. The method of claim 2, wherein the DC motor is at least one of: a brushless DC motor, an un-commutated DC motor, a permanent magnet DC motor, or a wound-stator DC motor.

4. The method of claim 1, further comprising:

producing, by the first motor, the second electrical energy during the stopping of the first motor.

5. The method of claim 1, wherein determining, by the control processor, that the received second electrical energy is substantially the same as a motor energy threshold; and switching, by the control processor, the second electrical energy to the capacitor bank upon the determining that the received second electrical energy is substantially the same as the motor energy threshold.

6. The method of claim 5, further comprising:

determining, by the control processor, an electrical energy level of the capacitor bank is at least one of: substantially the same as a capacitor energy threshold, above the capacitor energy threshold, or below the capacitor energy threshold; and charging, by the control processor, the capacitor bank with the second electrical energy at least upon the determining that the electrical energy level of the capacitor bank is below the capacitor energy threshold.

7. The method of claim 1, wherein providing the first electrical energy to the first motor further comprises:

determining, by the control processor, an electrical energy level of the capacitor bank is at least one of: substantially the same as a capacitor energy threshold, above the capacitor energy threshold, or below the capacitor energy threshold; and supplying, by the control processor, the first electrical energy to the first motor from the capacitor bank upon the determining that the electrical energy level of the capacitor bank is at least one of: substantially the same as the capacitor energy threshold, or above the capacitor energy threshold.

8. The method of claim 1, wherein providing the first electrical energy to the first motor further comprises:

determining, by the control processor, an electrical energy level of the capacitor bank is at least one of: substantially the same as a capacitor energy threshold, above the capacitor energy threshold, or below the capacitor energy threshold; and supplying, by the control processor, the first electrical energy to the first motor from the battery module upon the determining that the electrical energy level of the capacitor bank is below the capacitor energy threshold.

9. The method of claim 1, wherein the pulser further comprises the control processor and a rotary pulser, wherein the supplying the first electrical energy to the first motor at least as the first motor is operating further comprises:

supplying the first electrical energy to the first motor at least as the first motor operates to generate one or more pressure pulses of the rotary pulser.

10. The method of claim 9, further comprising:

producing the one or more pressure pulses with the rotary pulser;

determining, by the control processor, one or more parameters of the one or more pressure pulses, wherein the one or more parameters including one or more of: an amplitude of the one or more pressure pulses, a duration of the one or more pressure pulses, a shape of the one or more pressure pulses, or a frequency of the one or more pressure pulses; and interpreting, by the control processor, one or more characteristics of a drilling operation from the one or more parameters of the pressure pulses.

11. A pulser configured to operate at a down hole location in a well bore, the pulser comprising:

a pulser assembly having a housing, at least one rotatable element in the housing, and at least one passage, wherein the at least one rotatable element is configured to rotate to inhibit fluid flowing through the at least one passage to generate a pressure pulse in the fluid;

one or more motors coupled to the at least one rotatable element and configured to cause the at least one rotatable element to rotate;

a capacitor bank electronically coupled to the one or more motors; and a control processor electronically coupled to the one or more motors and the capacitor bank, the control processor configured to:

control operation of a first motor of the one or more motors to rotate the at least one rotatable element in order to generate a pressure pulse as fluid flows through the pulser assembly;

provide a first electrical energy to the first motor at least as the first motor operates;

receive a measurement of a determined position of the at least one rotatable element, wherein determined position of the at least one rotatable element is used to determine opening and closing of at least one switch to a battery module or a capacitor bank of the pulser;

receive a signal to stop the first motor;

stop the first motor so that the at least one rotatable element stops;

control receipt of a second electrical energy from the first motor at least as the first motor stops and the at least one rotatable element stops;

direct at least some of the second electrical energy to the capacitor bank.

12. The pulser of claim 11, wherein the first motor is a direct current (DC) motor.

13. The pulser of claim 12, wherein the second electrical energy is produced by the DC Motor as the DC Motor stops.

14. The pulser of claim 12, wherein the DC motor is at least one of: a brushless DC motor, an un-commutated DC motor, a permanent magnet DC motor, or a wound-stator DC motor.

15. The pulser of claim 11, wherein the control processor is further configured to:

determine that the received second electrical energy is at least one of: the same to a motor energy threshold, above the motor energy threshold, or below the motor energy threshold; and switch the second electrical energy to the capacitor bank upon a determination that the received second electrical energy is at least one of: the same to the motor energy threshold, or above the motor energy threshold.

16. The pulser of claim 15, wherein the control processor is further configured to:

determine an electrical energy level of the capacitor bank is at least one of: the same to a capacitor energy threshold, above the capacitor energy threshold, or below the capacitor energy threshold; and charge the capacitor bank with the second electrical energy at least upon a determination that the electrical energy level of the capacitor bank is below the capacitor energy threshold.

17. The pulser of claim 11, wherein the control processor is further configured to:

determine an electrical energy level of the capacitor bank is at least one of: the same to a capacitor energy threshold, above the capacitor energy threshold, or below the capacitor energy threshold; and provide the first electrical energy to the first motor from the capacitor bank upon a determination that the electrical energy level of the capacitor bank is at least one of: the same to the capacitor energy threshold, or above the capacitor energy threshold.

18. The pulser of claim 11, further comprising a battery module, wherein the control processor is further configured to:

determine an electrical energy level of the capacitor bank is at least one of: the same to a capacitor energy threshold, above the capacitor energy threshold, or below the capacitor energy threshold; and provide the first electrical energy to the first motor from the battery module upon a determination that the electrical energy level of the capacitor bank is below the capacitor energy threshold.

19. The pulser of claim 11, further comprising a rotary pulser, wherein the control processor is further configured to:

provide the first electrical energy to the first motor at least for operation of the first motor in one or more pulses of the rotary pulser.

20. The pulser of claim 19, wherein the rotary pulser configured to produce the one or more pulses in a drilling fluid, the control processor is configured to:

receive one or more pressure pulses produced by the rotary pulser;

determine one or more parameters of the one or more pressure pulses, the one or more parameters including one or more of: an amplitude of the one or more pressure pulses, a duration of the one or more pressure pulses, a shape of the one or more pressure pulses, or a frequency of the one or more pressure pulses; and interpret one or more characteristics of a drilling operation from the one or more parameters of the pressure pulses.

* * * * *